US008226082B2

(12) United States Patent
Seiler

(10) Patent No.: US 8,226,082 B2
(45) Date of Patent: Jul. 24, 2012

(54) APPARATUS AND METHOD FOR CONVEYING PRODUCTS FROM A STACK TO AN OUTPUT

(75) Inventor: Reinhard Seiler, Aindling (DE)

(73) Assignee: Boewe Systec AG, Augsburg (DE)

( * ) Notice: Subject to any disclaimer, the term of this patent is extended or adjusted under 35 U.S.C. 154(b) by 220 days.

(21) Appl. No.: 12/594,820

(22) PCT Filed: Feb. 20, 2008

(86) PCT No.: PCT/EP2008/001323
§ 371 (c)(1),
(2), (4) Date: Feb. 9, 2010

(87) PCT Pub. No.: WO2008/122327
PCT Pub. Date: Oct. 16, 2008

(65) Prior Publication Data

US 2010/0145503 A1 Jun. 10, 2010

(30) Foreign Application Priority Data

Apr. 5, 2007 (DE) ..... 10 2007 016 541

(51) Int. Cl.
*B65H 1/02* (2006.01)

(52) U.S. Cl. ..... 271/149; 271/146; 271/251

(58) Field of Classification Search ..... 271/146, 271/161, 129, 133–135, 139, 140, 149, 150, 271/166, 250, 251
See application file for complete search history.

(56) References Cited

U.S. PATENT DOCUMENTS

| | | | | | |
|---|---|---|---|---|---|
| 1,394,613 | A * | 10/1921 | Drury | 271/119 |
| 3,545,741 | A | 12/1970 | Porth | |
| 4,034,975 | A * | 7/1977 | Agnew et al. | 271/10.09 |
| 4,344,611 | A * | 8/1982 | Morita | 271/129 |
| 4,494,745 | A * | 1/1985 | Ward et al. | 271/95 |
| 5,232,123 | A * | 8/1993 | Richardson et al. | 221/259 |
| 5,393,045 | A * | 2/1995 | Fujimoto | 271/23 |
| 6,267,372 | B1 * | 7/2001 | Mylaeus et al. | 271/250 |
| 6,315,286 | B1 * | 11/2001 | Muenchinger et al. | 271/146 |
| 7,533,879 | B2 * | 5/2009 | Marasco | 271/146 |
| 7,980,420 | B2 * | 7/2011 | Yamamiya | 221/268 |
| 2004/0051232 | A1 * | 3/2004 | Masui et al. | 271/146 |

FOREIGN PATENT DOCUMENTS

| | | |
|---|---|---|
| DE | 195 40 922 | 5/1997 |
| EP | 0 224 939 A1 | 6/1987 |

* cited by examiner

*Primary Examiner* — Jeremy R Severson

(74) *Attorney, Agent, or Firm* — Brill Law Office; Jeffrey Brill

(57) ABSTRACT

An apparatus for conveying products from a stack to an output includes a stack area configured for receiving a stack of a plurality of products, a guiding element extending to the output, and a transport mechanism configured for acting on at least part of the products in the stack for conveying the products in the direction of the output such that edges of the products abut on the guiding element.

21 Claims, 14 Drawing Sheets

APPARATUS AND METHOD FOR CONVEYING PRODUCTS FROM A STACK TO AN OUTPUT

BACKGROUND OF THE INVENTION

The invention relates to an apparatus and a method for conveying products from a stack to an output.

Paper handling systems, such as enveloping systems, comprise applications in which, from a stack of products, e.g. sheets of paper or envelopes, one sheet or envelope each is provided for processing in the system. Such systems comprise, for example, supplement feeders or envelope feeders, but also folding units, to which products from a stack are provided individually or in groups from a stack.

SUMMARY

According to an embodiment, an apparatus for conveying products from a stack to an output may have: a stack area configured for receiving a stack of a plurality of products, wherein the stack area has a base plate with a surface for receiving the products and a stop transversal to a stacking direction of the products; a guiding element extending to the output; and a transport mechanism configured for acting on one or several of the products in the stack for conveying the products in the direction of the output, such that edges of the products abut on the guiding element, wherein the transport mechanism is implemented such that one transport element of the transport mechanism is disposed above the surface of the base plate during a movement from a first position to a second position, for raising at least part of the products in the stack, moving them in the direction of the guiding element and the stop and lower them on the surface of the base plate.

Another embodiment may have a paper handling apparatus having an inventive apparatus for conveying products from a stack to an output, wherein the paper handling apparatus is selected from a group having a supplement feeder for withdrawing products from a stack and for separating the products through the gap or a folding unit.

According to another embodiment, a method for conveying products from a stack of a plurality of products to an output, wherein the stack is arranged in a stack area having a base plate with a surface for receiving the products, a stop transversal to a stacking direction of the products and a guiding element extending to the output, may have the steps of: acting on one or several of the products in the stack for conveying the products in a direction of the output such that edges of the products abut on the guiding element, wherein the acting on the one or the several products has the steps of: moving a transport element above the base plate from a first position to a second position to thereby raise at least part of the products in the stack above the surface of the base plate, moving the part of the products in the direction of the guiding element and the stop, and lowering the part of the products on the surface of the base plate.

Another embodiment may have a computer program product having a program code stored on a machine-readable carrier for performing the inventive method, when the program product runs on a computer.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
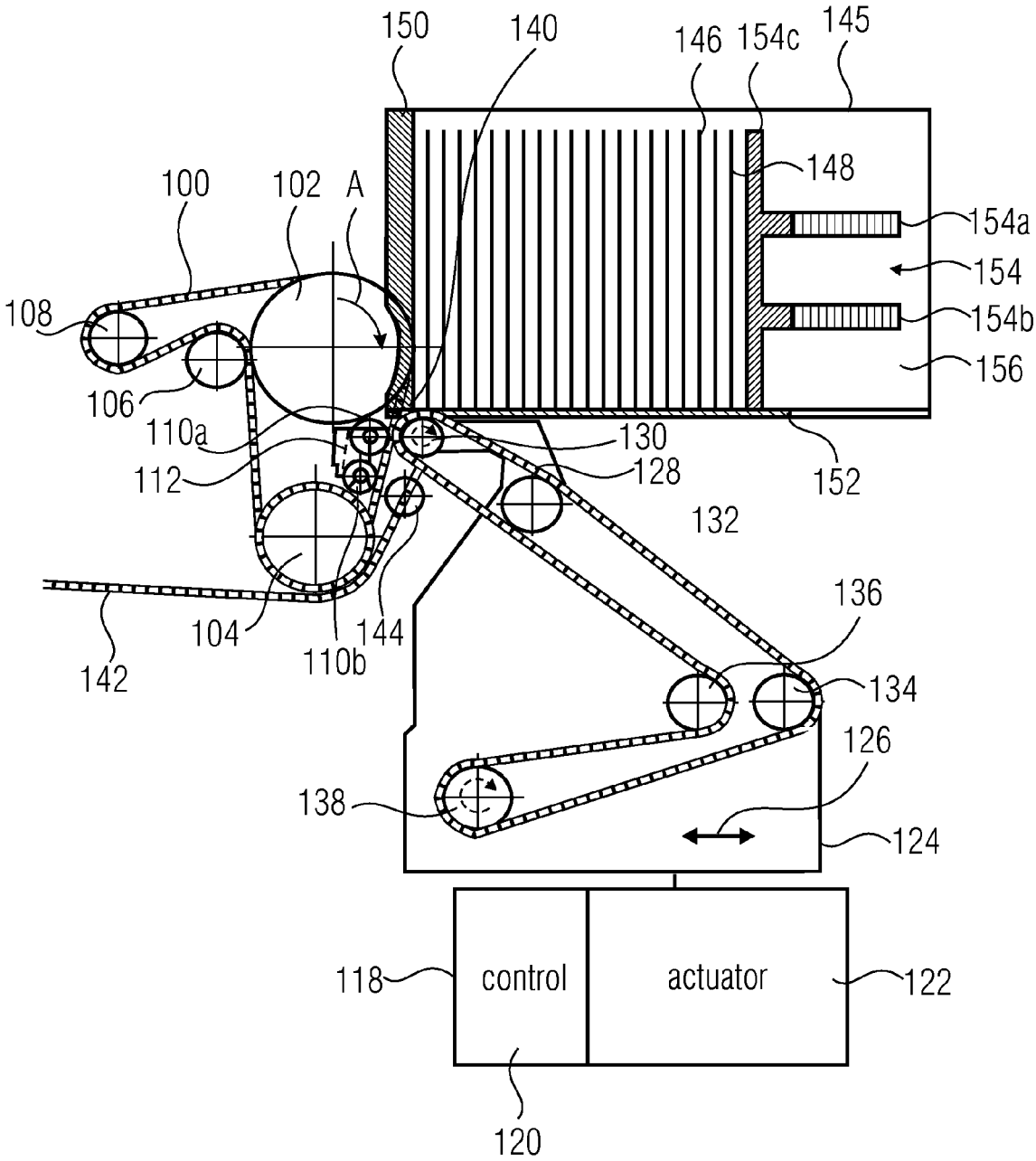
FIG. 1 is a schematical illustration of a supplement feeder.

In the following, based on the accompanying drawings, embodiments of the invention will be discussed, wherein similar or equal elements are provided with the same reference numbers in the drawings. Further, in the description, the term "plurality" is used, which means two or more.

FIG. 1 shows a supplement feeder comprising a conveyor belt 100 guided around a suction drum 102 as well as further guide rollers 104, 106 and 108. The conveyor belt 100 is driven in a conveying direction A. Further, two fixed lock rollers 110*a* and 110*b* are provided, which are arranged between the suction drum 102 and the guide roller 104 such that the conveyor belt 100 is also moved across the lock rollers. The lock rollers 110*a* and 110*b* are mounted to a holder 112.

The supplement feeder comprises a control 120 controlling the operation of the supplement feeder. The control 120 is connected to an actuator 122 for moving a chassis 124 as indicated by arrow 126. The lock reverse belt 128 is located in the chassis or carrier 124, which is guided across a plurality of guide rollers 130 to 138 and can be driven against the conveying direction A (in a clocked manner). As can be seen in FIG. 1, the chassis 124 and thus the reverse belt 128 are arranged such that the guide roller 130 is arranged opposite to the lock rollers 110*a* and 110*b* and opposite to the conveyor belt 100 across a hooked boss at the chassis 124. Here, a gap (also referred to as a lock gap) 140 is defined in an adjustable manner at this position by the spacing between the conveyor belt 100 or the lock rollers 110*a* and 110*b*, respectively, and the reverse belt 128. The actuator 122 effects lateral movement of the chassis 124 and thus of the reverse belt 128, whereby also the gap 140, i.e. the spacing between the rollers, can be adjusted.

Further, the supplement feeder comprises a deflector plate 142 as well as a reverse roller 144 for moving a product in a desired direction after separating.

Further, a product receptacle 145 for receiving a product stack 146, for example a sheet or paper stack, is provided, which is illustrated schematically in FIG. 1, from which the individual products 148 are withdrawn. The products 148 are arranged in the stack 146 in an upright manner (upright on one of the edges) and rest against a stop 150. The surface of the stop 150 facing the products 148 is flush with the belt 100 in a front area in the conveying direction A, wherein the suction drum and the conveyor belt 100 cooperate for sucking the foremost product of the stack 146 and moving the same in the conveying direction A. If the gap 140 is adjusted correctly, only a single product is passed. A product which is possibly withdrawn twice, i.e. a further withdrawn product, is retained due to the low width and the reverse belt 128 operating against the conveying direction.

Further, the product receptacle 145 comprises a guide element 152, extending towards the gap 140 through which the products are output. Apart from the shape shown in FIG. 1, the guide element 152, for example a guide plate, can also have other shapes. The guide element 152 can, for example, have a curve in the area of the gap 140 for guiding the products in the direction of the gap 140 and to the guide roller 130.

For supplying the products to the stop 150, the product receptacle 145 comprises a product transport 154 comprising two belts 154*a* and 154*b* arranged in parallel, which convey the introduced products upright in the direction of the stop 150. The product transport 154 further comprises a rear movable stop 154*c* holding the introduced products. The belts 154*a* and 154*b* are arranged in a base plate 156 of the product receptacle 145.

Experience has shown that the withdrawal results of the supplements 148 from the stack 146 are the better the more flush or exact, respectively, the supplements abut on the lock, i.e. on the lock sheet 152 or to the reverse roller 130 (or to the reverse belt, respectively). Experience has also shown that the withdrawal results of the supplements are the better the more consequent the supplements were pre-singulated or separated from each other, respectively, prior to the withdrawal, for example, by shaking up the supplements 148 in the stack 146 prior to inserting the stack 146 in the product receptable 145. Conventional approaches for producing an abutment of the supplements on the lock, i.e. on the lock sheet 152 and/or on the reverse roller 130, that is as precise as possible, use passive elements, such as slants, slides, guides. The resulting weights move the individual products in direction of the lock sheet 152 or in direction of the reverse roller 130, respectively. However, these approaches do not operate in a reliable manner, since, depending on a plurality of parameters and environmental circumstances, different forces can act on the supplements, so that no precise abutment on the lock sheet 152 or reverse roller 130, respectively, is ensured.

Hence, there is a need for providing an arrangement and a method allowing secure abutment of products in a stack on a lock sheet or a reverse roller, respectively.

Embodiments of the invention provide a method and an apparatus for conveying products from a stack to an output providing a continuous conveyor unit (vibratory conveyor means) in the area of the withdrawal unit and the lock, wherein embodiments of the continuous conveyor unit are realized based on a circularly rotating disk controlling a moving element via an eccentric. Positioning this moving element at a certain angle to the lock can support the movement of the product towards the lock. Embodiments of the invention provide a continuous conveyor unit that can convey the product permanently and continuously towards the lock, such that precise abutment of the product on the lock (lock sheet/reverse roller) can be ensured. Further, embodiments of the invention can allow pre-separation of the supplements ready for withdrawal in the stack, by respectively vibrating with the vibratory conveyor means, wherein further embodiments can additionally support the separation by blowing-in air. A pre-separation in an upstream element such as by a pre-stacker is not necessitated, such that embodiments of the invention can avoid the arrangement of a complete additional functional unit.

Embodiments of the invention can be realized as a digital memory medium, for example a disk or file, comprising electronically readable control signals that can cooperate with a programmable computer system such that the method according to embodiments of the invention is performed. Further, the invention can be implemented as a computer program product with a program code for performing the method stored on a machine-readable carrier, when the program product runs on a computer. Also, the invention can be implemented in the form of a computer program with a program code for performing the method according to embodiments of the invention, when the program runs on a computer.

Figure 2:
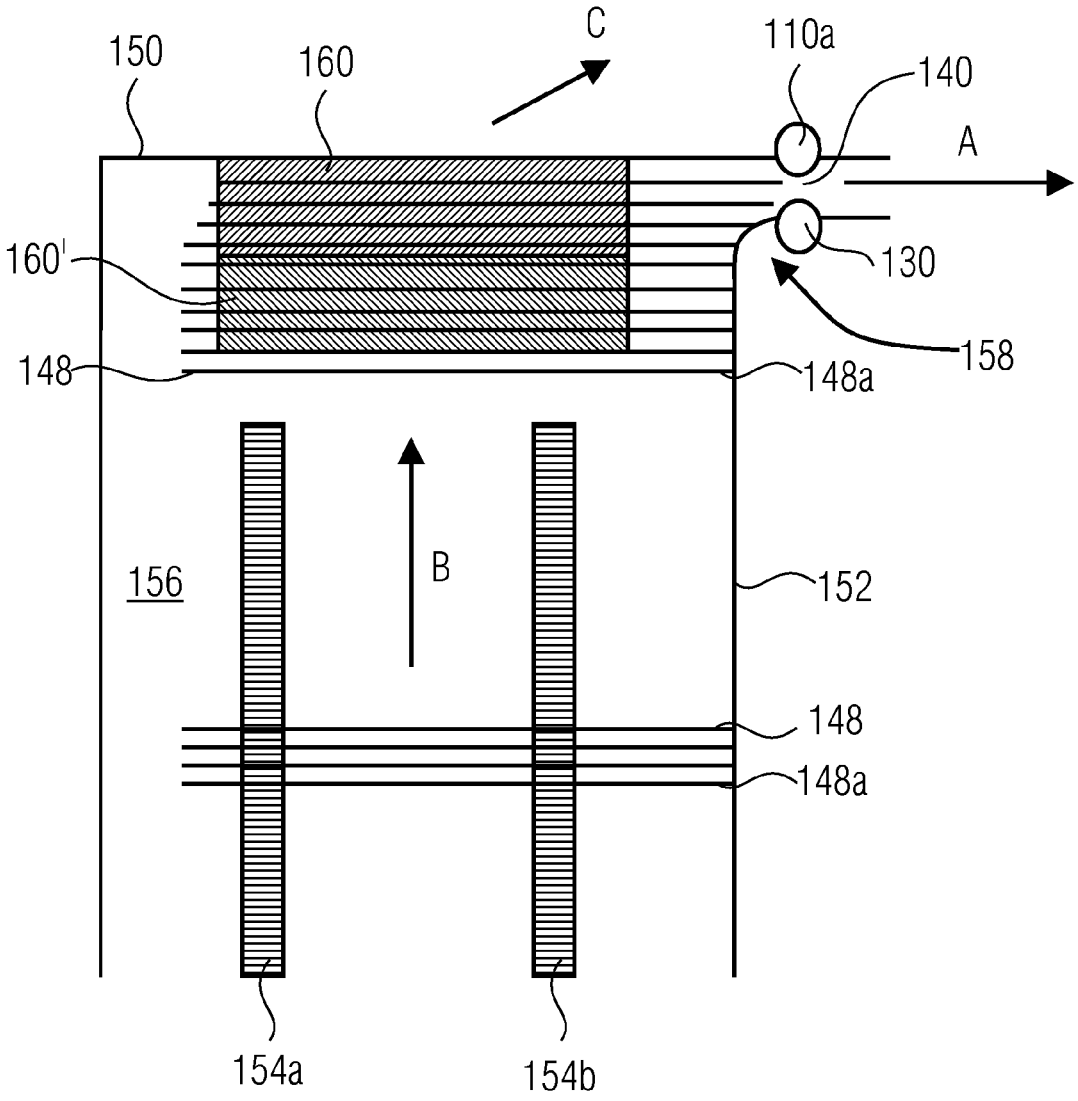
FIG. 2 is a schematical top view illustration of a supplement feeder having a transport mechanism according to embodiments of the invention.

FIG. 2 shows a schematical top view of a supplement feeder with a transport mechanism according to an embodiment of the invention. Elements that have already been described with regards to FIG. 1 are provided with the same reference numerals in FIG. 2. A repeated description of these elements is omitted. As can be seen in FIG. 2, for clarity reasons, the vacuum transport shown in FIG. 1 as well as the transport belt 100 have been omitted and merely the two rollers 110*a* and 130 defining the gap 140 are shown. Further, the products 148 are shown with a clear distance to each other, wherein, however, it should be noted that this is merely for illustration reasons. During normal operation, the individual products 148 directly abut on each other. The products 148 are moved via the belts 154*a* and 154*b* in the direction B to the stop 150, as has already been described based on FIG. 1. In FIG. 2, the course of the lock sheet 152 is illustrated in more detail again. As can be seen, in the area 158, the lock sheet 152 comprises a rounding in the direction of the roller 130 for guiding the products 148 to the gap 140. As has been discussed above, for obtaining good withdrawal results, it is desirable that the edges 148*a* of the products 148 are applied to the lock sheet 152 during the transport of the products 148 in the direction of the gap 140 for transporting in the direction A, i.e. abut on the same. In particular, the edges 148*a* of the products 148 should follow the course of the lock sheet 152 also in the area of the rounding 158. For that reason, the supplement feeder shown in FIG. 2 comprises the schematically shown conveyor unit 116 allowing continuous conveying of the products 148 in the direction of the gap 140, such that the edges 148*a* of the products 148 abut on the guiding sheet 152. According to embodiments of the invention, the transport unit 160 can affect conveyance of the products 148 in a direction C, which is directed in the direction of the gap 140 and can have any angle in relation to the feed direction B.

Embodiments can provide a further transport mechanism 160', which is shown schematically in FIG. 2. The further transport mechanism 160' can be configured such that the same acts on at least a further part of the products 148 in the stack 146 for conveying the products 148 in the direction of the output 140, such that edges 148*a* of the products 148 abut on the guiding element 152, 130. The further transport mechanism 160' can be arranged in parallel to the first transport mechanism 160 and can be configured for being driven synchronously with the first transport mechanism 160 or counter-rotating to the first transport mechanism 160. The further transport mechanism 160' can be realized according to the described embodiments.

Figure 3:
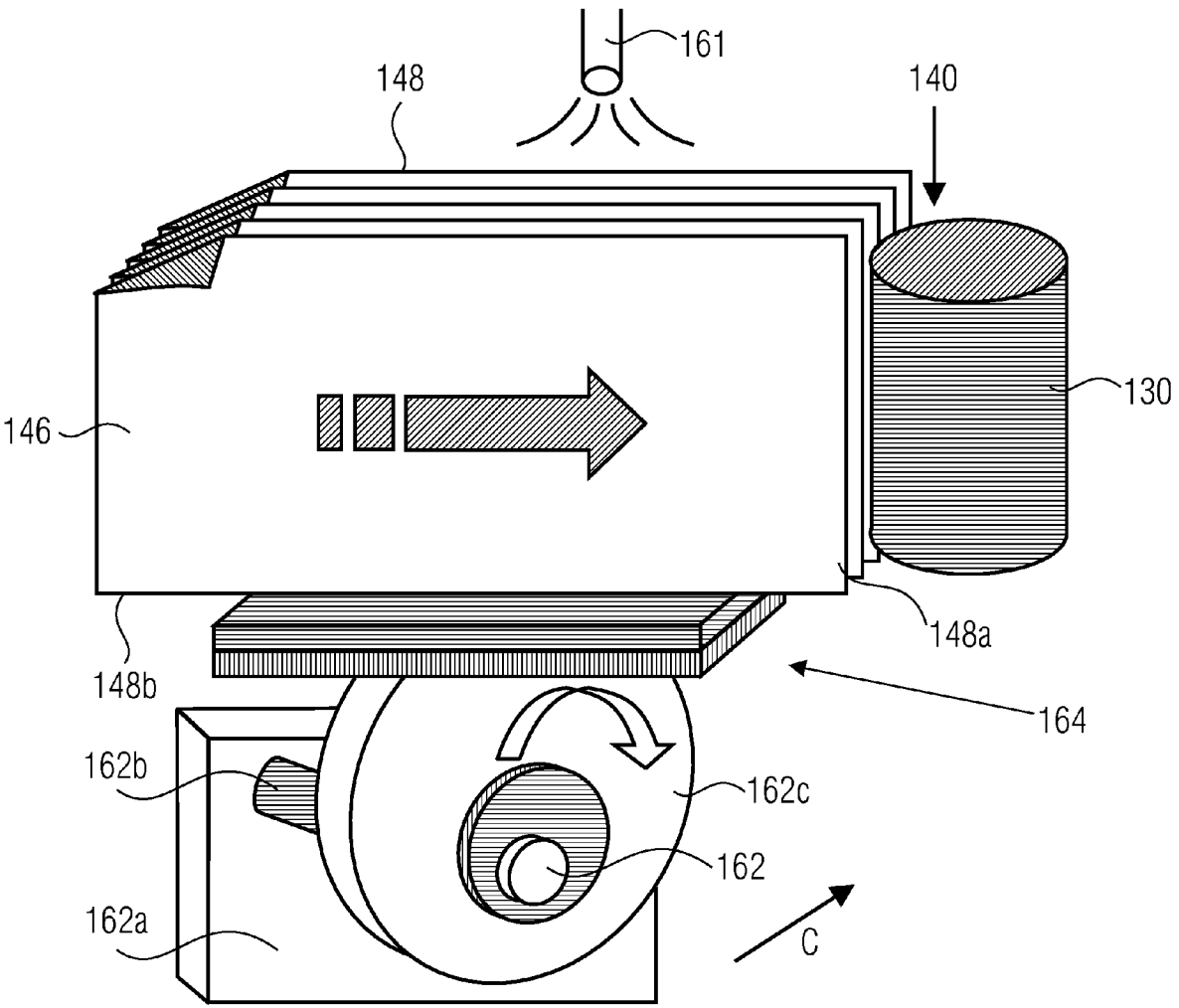
FIG. 3 is a schematical isometric partial illustration of the supplement feeder of FIG. 2.

FIG. 3 shows a schematic isometric partial view of the supplement feeder of FIG. 2, in particular an embodiment of the transport unit 160 having an eccentric drive 162 as well as a vibratory plate 164, which is effectively connected to the eccentric drive 162. The eccentric drive 162 comprises a motor 162*a* driving a shaft 162*b*, on which the disk 162*c* is eccentrically disposed. The disk 162*c* acts on the plate 164. As can be seen, the drive 162 can be arranged at an angle in relation to the transport element 164 for allowing a movement of the products in the desired direction. The drive 162 is angular-adjustable and can be adjusted to any desired angle between 0° and 360° in relation to the plate 162, depending on the desired conveying direction. The vibratory plate 164 is embedded in the base plate 156, wherein the eccentric drive 162 has the effect that the vibratory plate 164 raises, starting from a position below the base plate 156, above the same, engages the lower edges 148*b* of the products 148, raises the products, conveys the same in the direction C and lowers them again, and returns to the starting position in a second cycle section, as it will be described in more detail below. This is the effect that the conveyed products are kept very close to the withdrawal lock 140, wherein the angle at which the products 148 are conveyed can be selected in dependence on the arrangement of the gap with regard to the feeding direction B, for example, 45° in the direction of the withdrawal/output.

The vibratory frequency is approximately 1 Hz to approximately 100 Hz according to embodiments, wherein the stroke of the vibratory plate 164 can be approximately 1.2 mm during one cycle. "Vibrating", the products by the movement of the transport mechanism 160 can further effect pre-separation of the products 148, such that it is easier to withdraw individual products from the stack. Embodiments can support this separation by a blow-air supply 161 directed on the stack area.

Instead of the eccentric drive, embodiments can use a drive comprising a stroke element for raising and lowering the transport element in relation to the surface of the base plate 156, and a transverse drive for moving the transport element between the first and second positions.

Figure 4:
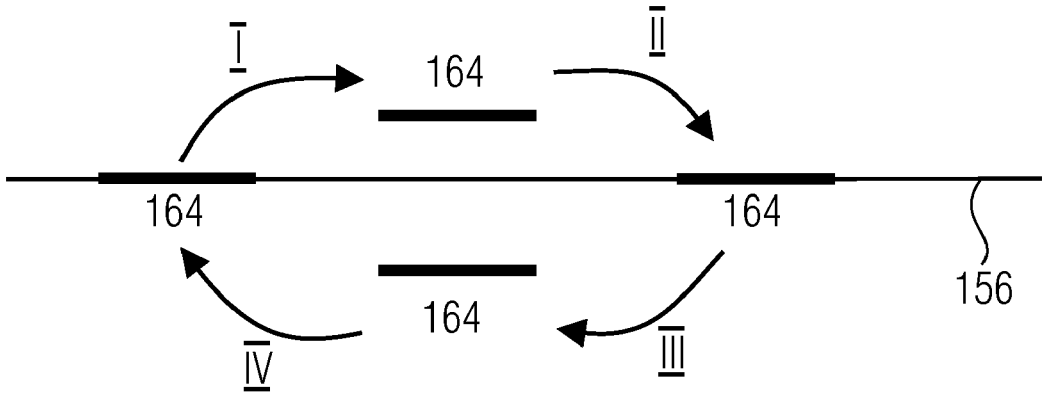
FIG. 4 is side view showing two sections of a transport cycle of a transport mechanism according to embodiments of the invention.

FIG. 4 shows schematically the two sections of a transport cycle of a transport conveyor unit 160, as has been discussed above based on FIGS. 2 and 3. FIG. 4 shows schematically the base plate 156, as well as, depending on the eccentric position, the position of the vibratory or transport plate 164 in relation to the base plate 156. In a first step of the transport cycle, the plate 164 is moved from a first position to the level of the base plate 156 to a position above the level 156 and back to the level 156, as indicated by arrows 1 and 2. In the second step of the cycle, the plate 164 moves back to its original position, as illustrated by arrows III and IV, wherein the movement is performed below the level 156. The height of the vibratory plate 164 is selected such that maximally half of the eccentric operation is above the surface of the table or the base plate 156, respectively.

Figure 5A:
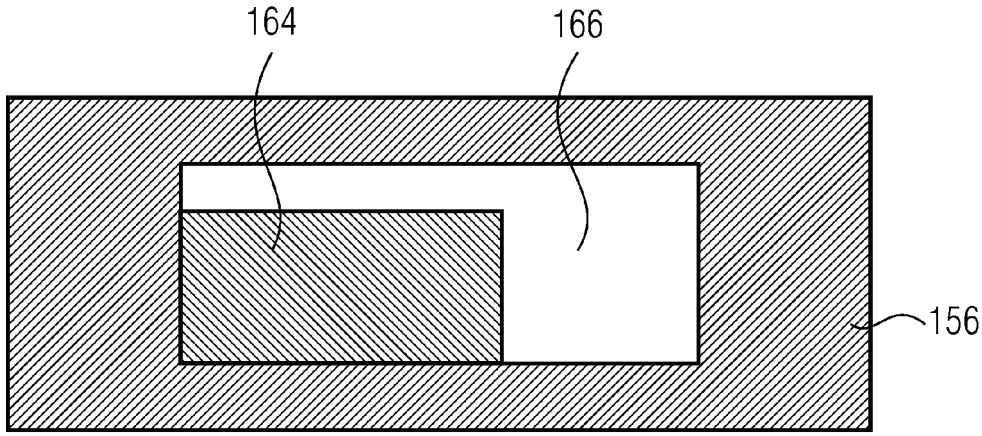
FIGS. 5A-5C are top views of the movement of a vibratory plate of a transport mechanism according to an embodiment.

FIG. 5 shows different illustrations of the movement of the vibratory plate 164 when running through the first section of the cycle. As FIG. 5A shows, a recess 166 is provided in the base plate 156, through which the vibratory plate 164 can extend through the base plate 156. As can be seen, the dimension of the recess 166 is selected larger than the dimension of the vibratory plate 164 for allowing a respective movement of the vibratory plate. Here, it should be noted that the distances are illustrated in a clearly exaggerated manner for illustrating the functional principle. In reality, the distances are much smaller. Depending on an angular arrangement of the drive, the conveying direction can be arbitrary, e.g. in parallel to one of the edges of the base plate or at any angle to the same.

Figure 5B:
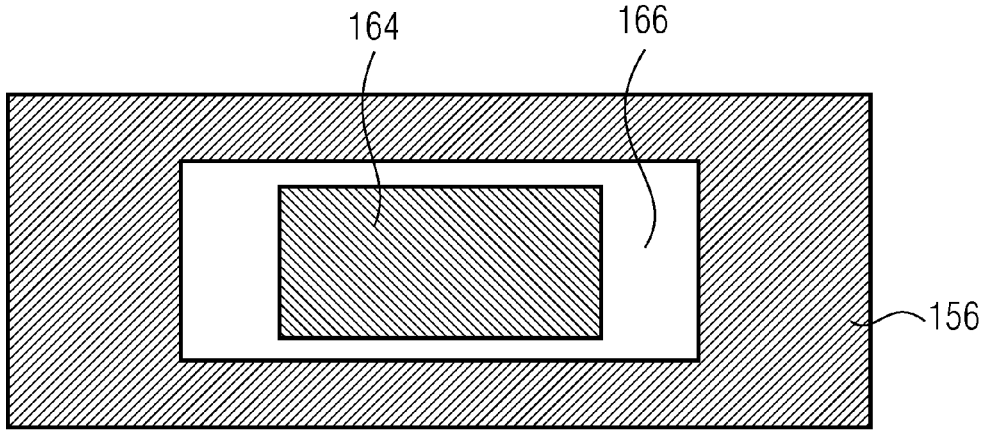
Figure 5C:
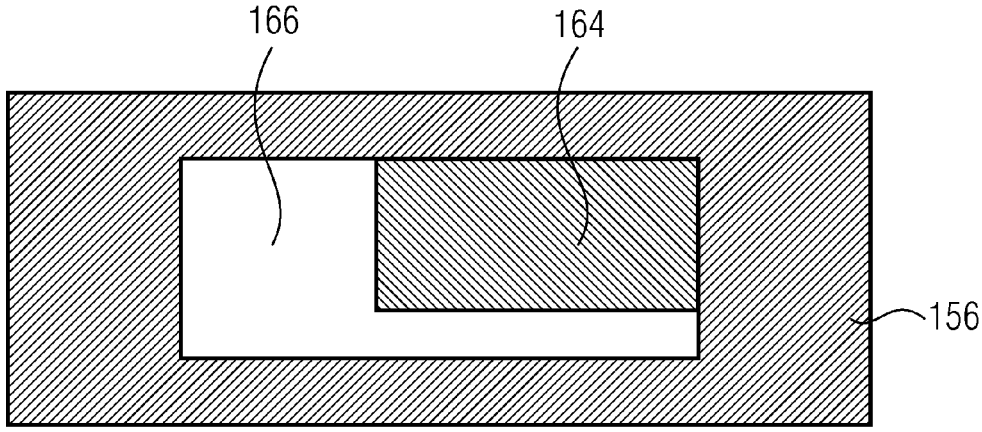

FIG. 5A shows the position at the beginning of the first section of the cycle of the transport unit, wherein the transport unit is implemented for transporting at an angle in the direction of the right upper corner of the base plate 156. For that purpose, the eccentric drive unit 162 is aligned correspondingly to the vibratory plate 164, for obtaining a movement of the vibratory plate 164 by a respective eccentric movement, as is described based on FIG. 5. As mentioned, FIG. 5A shows a first position, where the vibratory plate is disposed at a position at the bottom left in the recess 166. While passing through the first section (see arrow I in FIG. 4), the vibratory plate 164 is moved upwards, which means beyond the surface of the base plate 156, and is then approximately in the middle of the recess 166, as is shown in FIG. 5B. Towards the end of the first section (see arrow II in FIG. 4), the vibratory plate 164 is lowered again and is, prior to a reverse of the moving direction of the eccentric, in the right upper corner of the recess 166, substantially in the level of the plate 156. The second section of the cycle, i.e. the return of the vibratory plate 164 from the position shown in FIG. 5*c* to the position shown in FIG. 5A, is performed correspondingly, wherein in this section, the plate 164 is lowered below the surface of the base plate 156 in the intermediate step.

Figure 6:
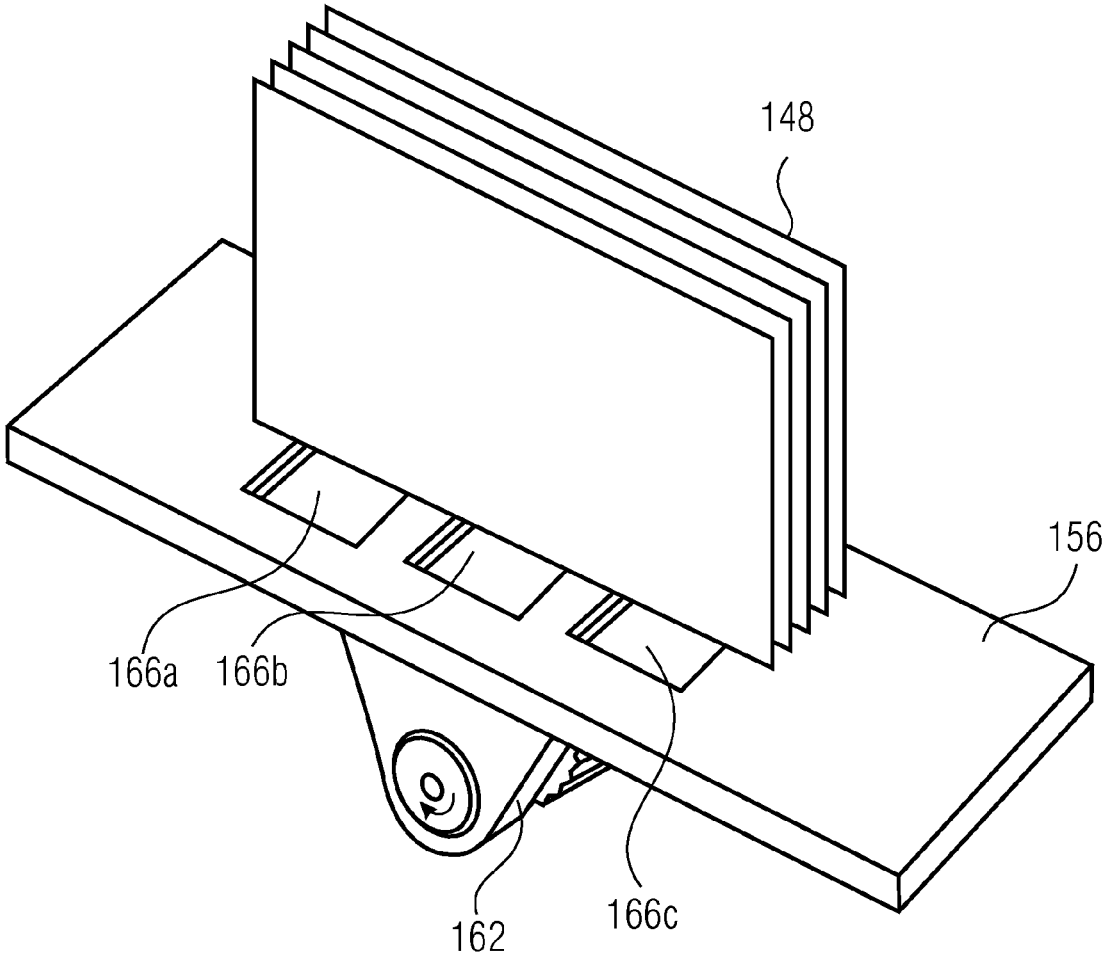
FIG. 6 is an isometric view of a transport mechanism according to a further embodiment.
Figure 7A:
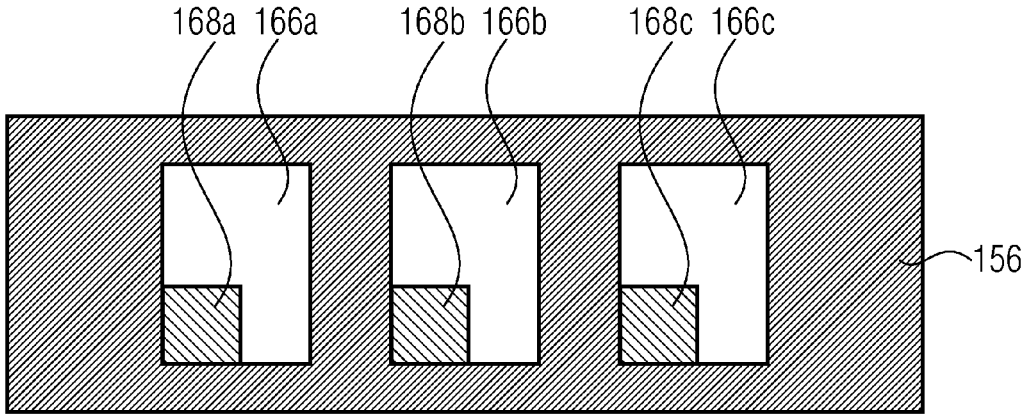
FIGS. 7A-7C are top views of the movement of the three-part vibratory plate of the transport mechanism of FIG. 6.
Figure 7B:
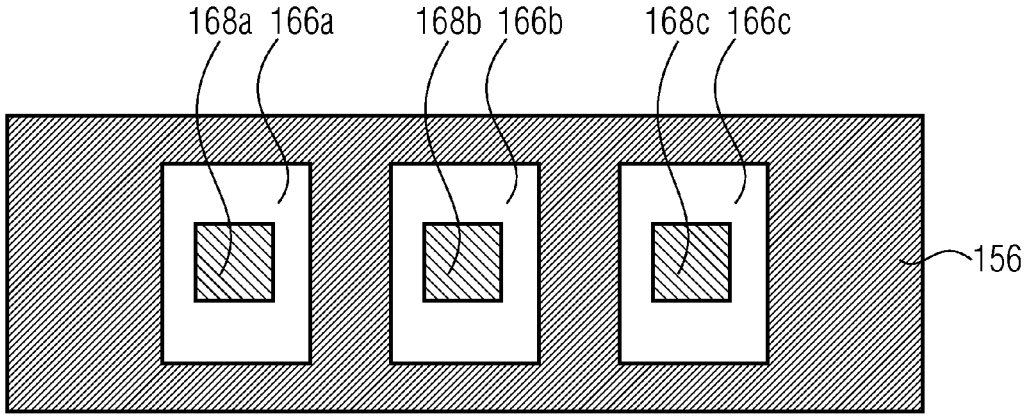
Figure 7C:
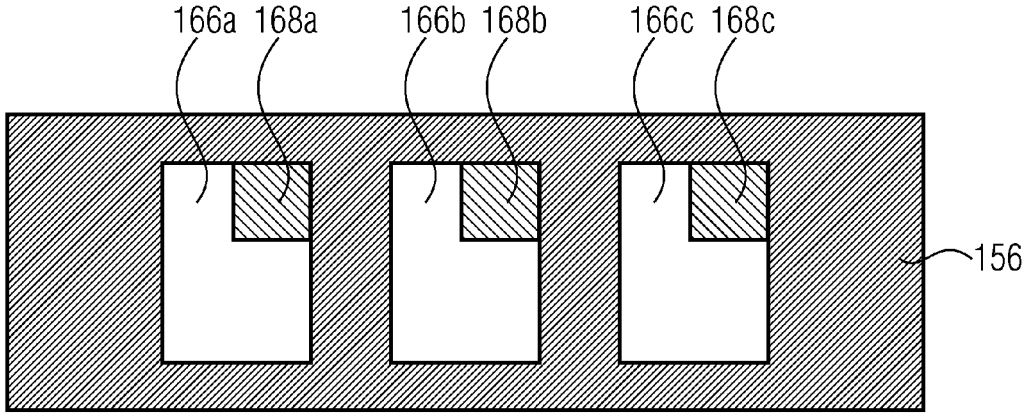

Based on FIG. 6, a further embodiment of the invention will be described below. FIG. 6 shows an isometric illustration of a transport mechanism, where the base plate 156 comprises three recesses 166*a* to 166*c* through which the projections of the vibratory plate not shown in FIG. 6 can extend for transporting the products 148. Similar to FIG. 5, FIG. 7 shows the different positions of the respective projections 168*a* to 168*c* of the vibratory plate during the first section of the cycle of movement through the respective recesses 166*a* to 166*c*. Here, also, movement is to be preformed in the direction of the right upper corner of the base plate 156. As can be seen, the movement of the individual elements 168*a* to 168*c* is performed in the respective recesses 166*a* to 166*c* in a way as has been described above, based on FIG. 5 in more detail, so that a renewed description is omitted.

Figure 8A:
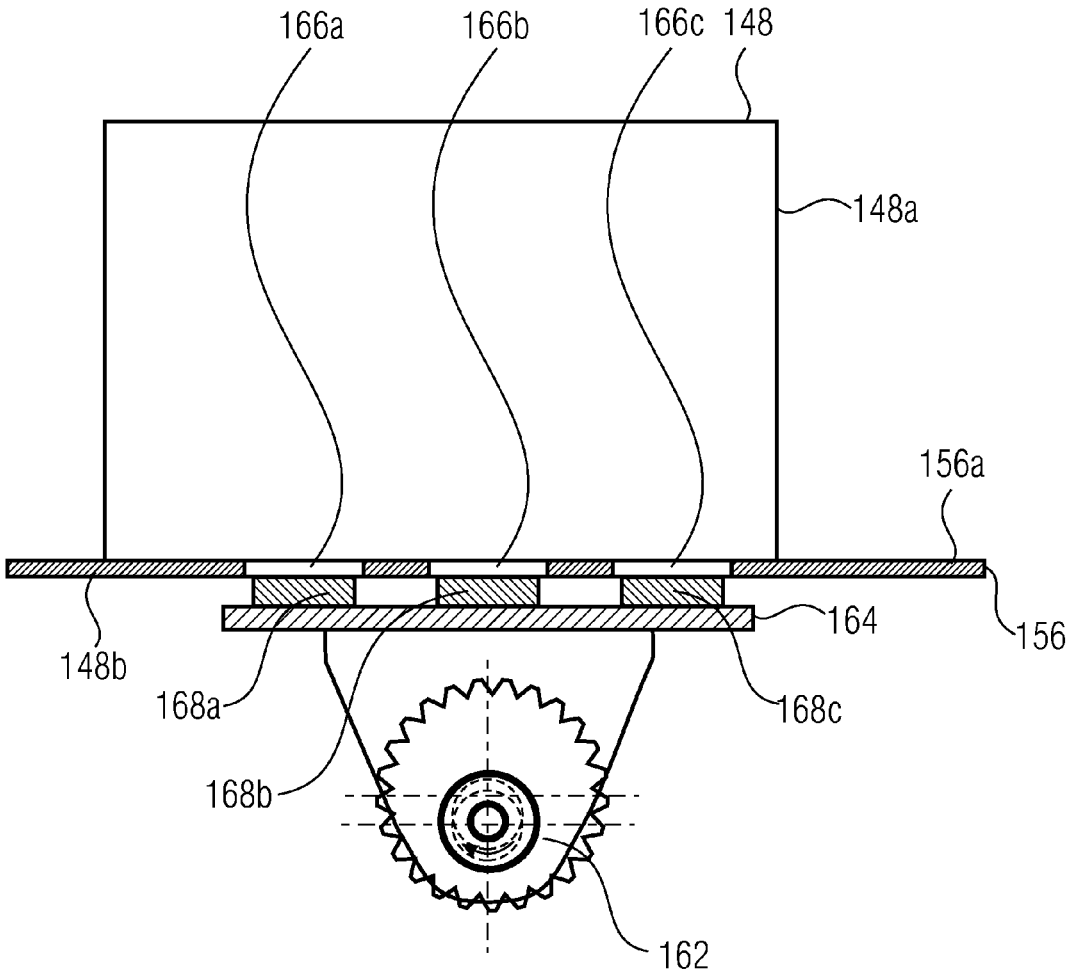
FIGS. 8A-8D side views of the movement of the three-part vibratory plate of the transport mechanism of FIG. 6 during the two sections of the transport cycle.

FIG. 8A to 8D show side views of the movement of the three-part transport plate of the transport mechanism of FIG. 6 during the two sections of the transport cycle. FIG. 8A shows an initial position where the eccentric drive 162 is at a position where the plate 164 and the projections 168*a* to 168*c* are arranged below an upper surface 156*a* of the base plate 156. As can be seen, in this case, the lower edges 148*b* of the products 148 rest on the upper surface 156*a* of the base plate 156.

Figure 8B:
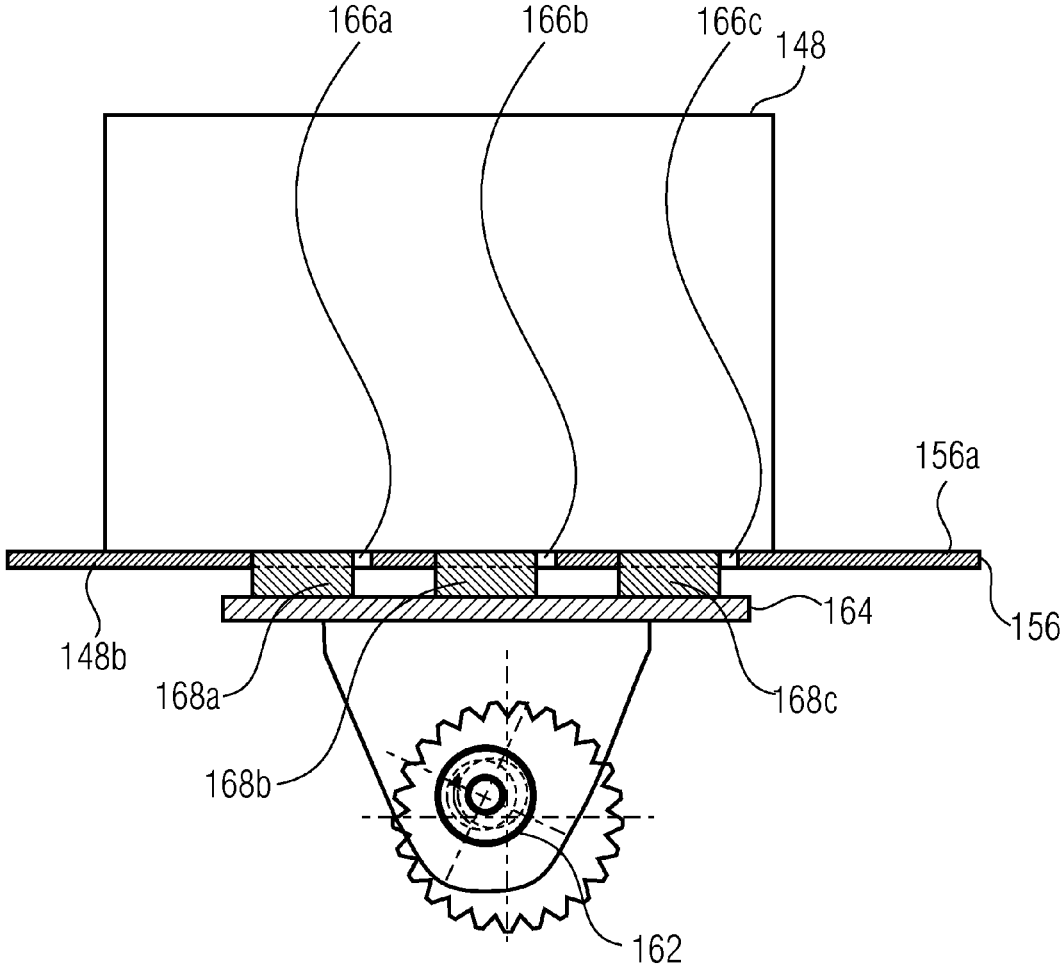

FIG. 8B shows the situation where the eccentric drive 162 has moved from the position shown in FIG. 8A in a clockwise manner by a predetermined distance, whereby the plate 164 and the projections 168 arranged thereon are raised, such that the same are flush left (in the figure) in the recesses 166. The surfaces of the projections 168 are substantially flush with the surface of the base plate 156. In this case, the bottom edges 148*b* of the products 148 rest both on the upper surface 156*a* of the plate 156 and on the upper surfaces of the projections 168 of the vibratory plate 164.

Figure 8C:
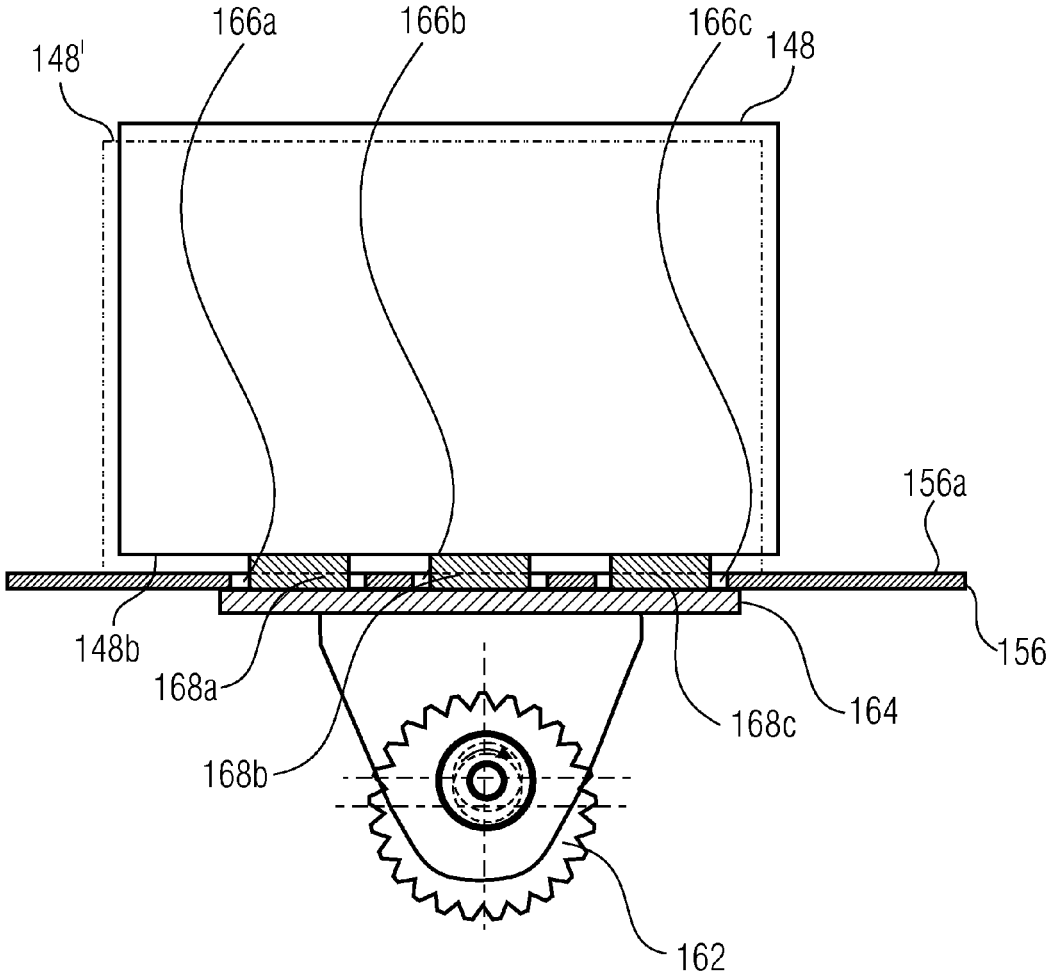

FIG. 8C shows a situation where the extensive drive 162 has been moved by approximately 180° in relation to the situation shown in FIG. 8A, such that in this situation the maximum projection of the projections 168 above the surface 166*a* of the plate 156 is obtained. In this situation, the bottom edges 148*b* of the products 148 are supported only by the projections 168 and do no longer rest on the surface 156*a* of the plate 156. FIG. 8C illustrates again at 148' the original position of the products 148 as has been shown based on FIGS. 8A and 8B.

Figure 8D:
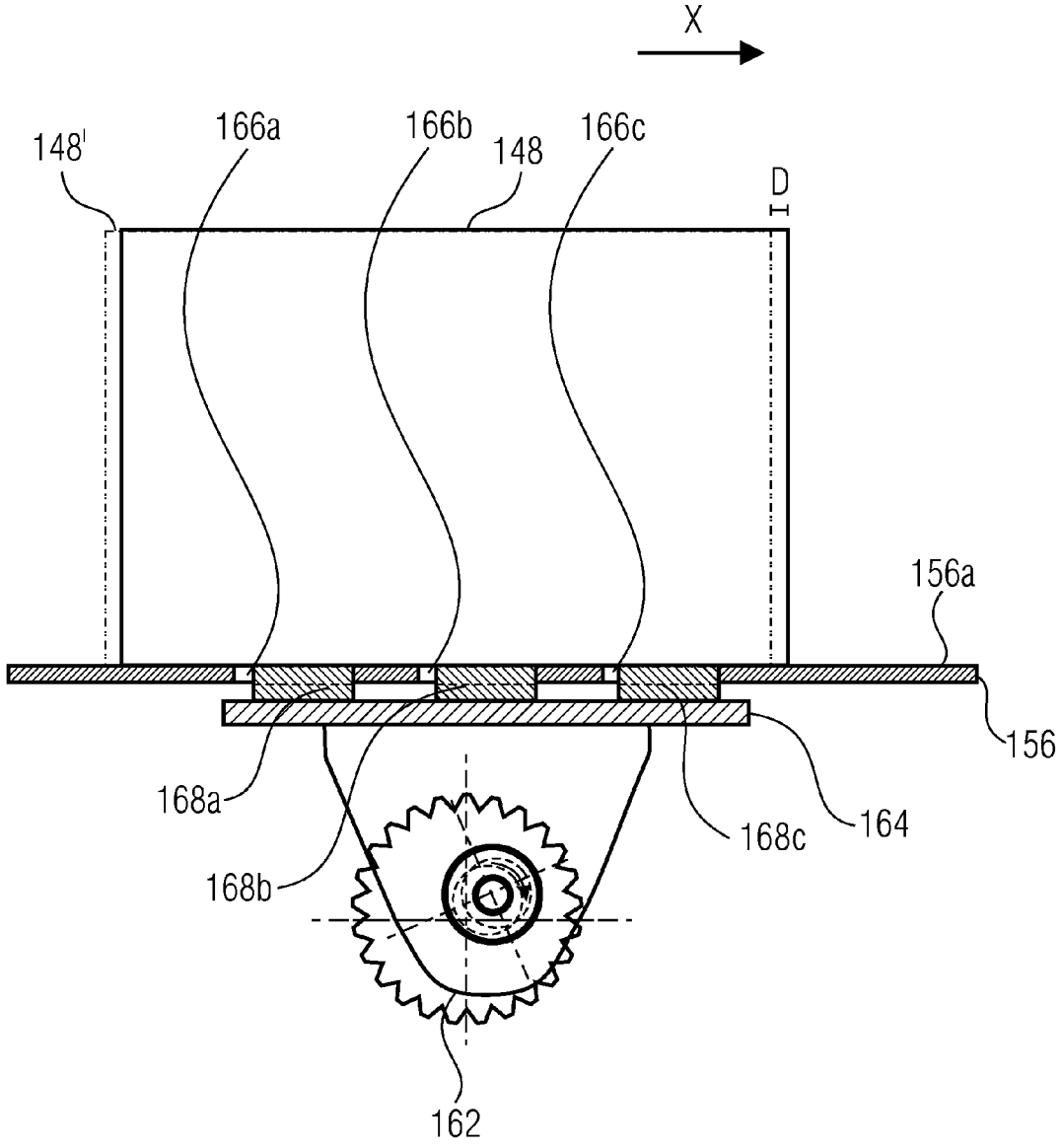

FIG. 8D shows the situation where the eccentric drive 162 has performed a further clockwise rotation, which has resulted in lowering the projections 168 of the plate 164, so that the same are now substantially flush with the surface 156*a* of the plate 156, so that the lower edge 148*b* of the products 148 rests again both on the surface 156*a* and on the surfaces of the projections 166.

As can be seen, the cycle of movement just described based on FIGS. 8A-8D causes a movement of the products 148 from the position shown at 148' in FIG. 8D to the position shown at 148, i.e. that products 148 have been moved in a direction X by the amount D.

The embodiment described based on FIGS. 6 to 8 comprises the transport element with the plurality of elements 168*a*-168*c* for engaging the products 148 arranged on a common plate. Further embodiments comprise a plurality of elements 168*a-c* for engaging the products in the manner described based on FIGS. 6 to 8, wherein the elements are not supported together by a plate, but are supported and driven separately. For that purpose, a number of drives, e.g. eccentric drives, corresponding to the number of elements can be provided, that cooperate for driving the elements for conveying the products.

Embodiments can also have only two elements or more than three elements.

The usage of several elements in the manner described based on FIGS. 6 to 8 can be advantageous, since thereby the transport of products with different dimensions can be supported. As described above, a product should be moved by the transport mechanisms in the direction of the guide, by raising the product, moving and lowering the same again. After lowering the product, the front and back sections of the lower edge 148 of the product 148 in a conveying direction should abut on the base plate. If the dimension of the product is sufficiently large, this will allow that the front and back sections of the lower edge 148*b* of the product project above the base plate. If products with shorter dimensions along the conveying directions are to used, the situation can occur that those "short" products abut only with the front section of the lower edge 148*b* of the product in a conveying direction on the base plate after lowering the product. The back section abuts on the transport plate. This can cause an insufficient transport. By using several elements with spaces in-between (see FIGS. 6-8), it can be achieved even with "short" products that after lowering the product, in addition to the front section of the lower edge 148*b* of the product in conveying direction, also its back section is supported.

The operating frequency with which the above described cycles are repeated, can be between approximately 1 Hz and approximately 100 Hz in embodiments, such that some sort of vibratory transport is obtained in the direction of the output, and simultaneously pre-separation of the individual products 148 in the stack can be obtained.

By the constant and continuous movement in the above-described manner in the direction of the output, abutment of the edges 148*a* of the products 148 on the lock sheet/on the lock roller can be ensured, whereby the withdrawal behavior can be improved.

The embodiments have been discussed in the context of a supplement feeder, wherein, however, it should be noted here that the invention is not limited to the usage with supplement feeders. Rather, embodiments of the invention are applicable in a plurality of positions within a paper-handling unit. The transport unit can be used anywhere where transport of upright or lying-down product stacks in the direction of an output is desired, in particular when an abutment of edges of the products on a guide is desirable, e.g. in a sheet feeder or an envelope feeder.

Figure 9A:
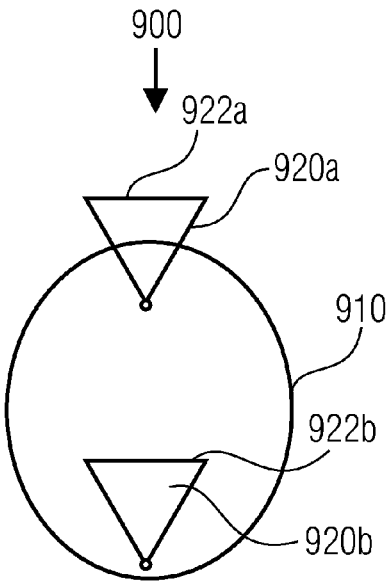
FIG. 9*a* is a side view on a transport mechanism according to an embodiment.

FIG. 9*a* shows a side view of a transport mechanism according to further embodiments. A transport mechanism according to FIG. 9*a* is indicated by 900 in its entirety. The transport mechanism 900 comprises a driving element 910, which is attached, for example, in a rotatable manner at a shaft. Further, the transport mechanism 900 comprises a plurality of vibratory plate elements 920*a*, 920*b*, which are arranged at the driving element 910, for example, for alternately contacting the products 148. For example, the vibratory plate elements 920*a*, 920*b* can be arranged at the driving element 910, for performing the same movements with a certain phase shift (in relation to the rotation of the driving element 910). Alternatively, however, the vibratory plate elements 920*a*, 920*b* can also perform different movement sequences. In this regard, it should be noted that a surface 922*a* of the first vibratory plate element 920*a* in one embodiment of the present invention substantially fulfills the same function as the vibratory plate 164, or of the elements 168*a*, 168*b*, 168*c*, respectively. Further, in one embodiment of the present invention, a surface 922*b* of the second vibratory plate element 940*b* fulfills substantially the same function as the vibratory plate 164 or one of the elements 168*a*, 168*b*, 168*c*, respectively. Correspondingly, in one embodiment of the present invention, surfaces 922*a*, 922*b* each perform substantially a movement as described with regard to FIG. 4. Further, alternatively, surfaces 922*a*, 922*b* can also take on the same functions as the individual elements 168*a*, 168*b*, 168*c*.

Further, it should be noted that the individual vibratory plate elements 920*a*, 920*b* can be arranged, for example, in a rigid or movable manner at the driving element 910. In one embodiment, the vibratory plate elements 920*a*, 920*b* are arranged such at the driving element 910 that the surfaces 922*a*, 922*b* of all vibratory plate elements 920*a*, 920*b* serving as vibratory plate have the same orientation in relation to the products. This can, for example, be obtained by the effect of gravitation (center of mass below a rotating point) or by a respective drive (for example by using a gear).

Figure 9B:
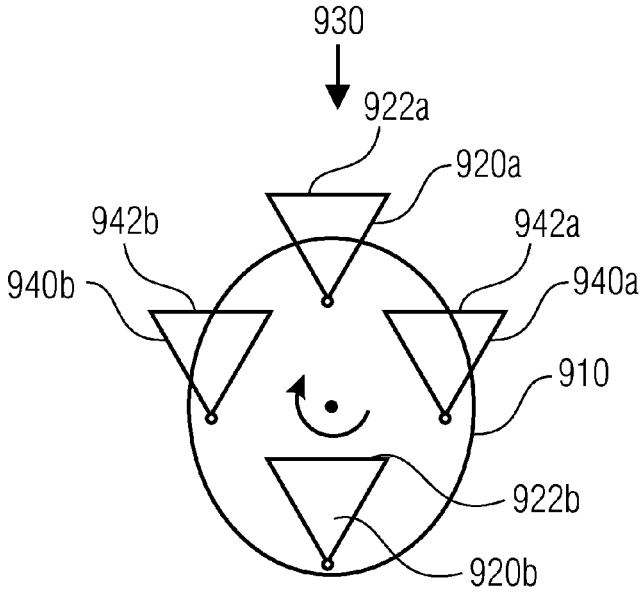
FIG. 9*b* is a side view on a further transport mechanism according to a further embodiment.

FIG. 9*b* shows a side view of a further transport mechanism according to a further embodiment. The transport mechanism according to FIG. 9*b* is indicated by 930 in its entirety and corresponds substantially to the transport mechanism 900 according to FIG. 9*a*. Thus, the same means are provided with the same reference numerals. In addition to the means of the transport mechanism 900, the transport mechanism 930 comprises two further vibratory plate elements 940*a*, 940*b* with respective surfaces 942*a*, 942*b* serving as vibratory plate.

In summary, it can be said that a plurality of vibratory plate elements 920*a*, 920*b*, 940*a*, 940*b* can be mounted on a drive 910, which each provide at least one vibratory plate in the form of respective surfaces. The driving element can, for example, be a pivoted disk, which acts as eccentric drive in one embodiment for each of the vibratory plate elements. The individual vibratory plate elements can, for example, contact the products during operation at a rotary movement of the driving element subsequently or offset in time, respectively.

Figure 9C:
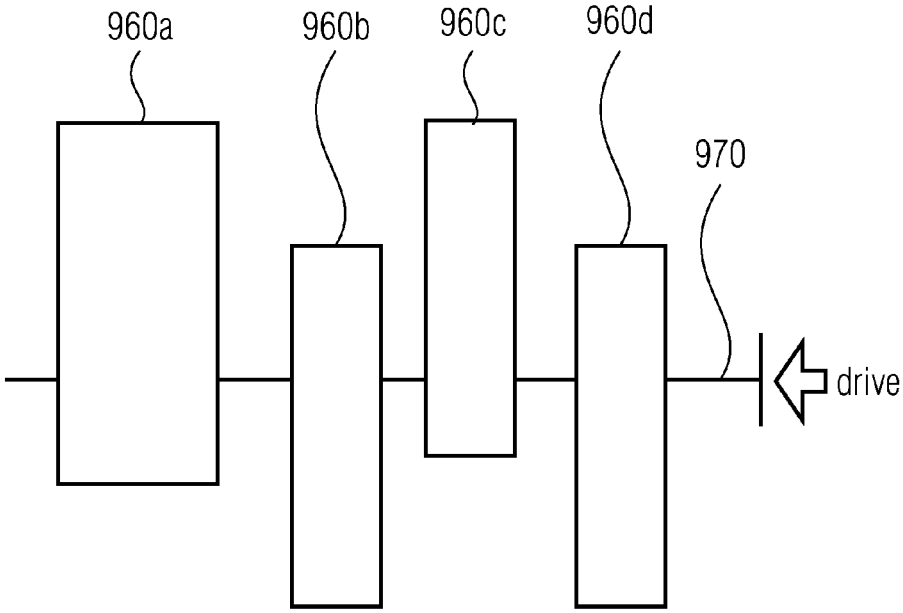
FIG. 9*c* is a top view on a further transport mechanism according to a further embodiment.

FIG. 9*c* shows the top view of a further transport mechanism according to a further embodiment of the present invention. The transport mechanism according to FIG. 9*c* is indicated by 950 in its entirety and comprises a plurality of vibratory plates or vibratory plate surfaces 960*a*, 960*b*, 960*c*, 960*d*, that are driven, for example, via a common drive 970 and perform out-of-phase movements. In other words, the individual vibratory plates or vibratory plate surfaces 960*a*, 960*b*, 960*c*, 960*d* belong to individual transport means.

Figure 10:
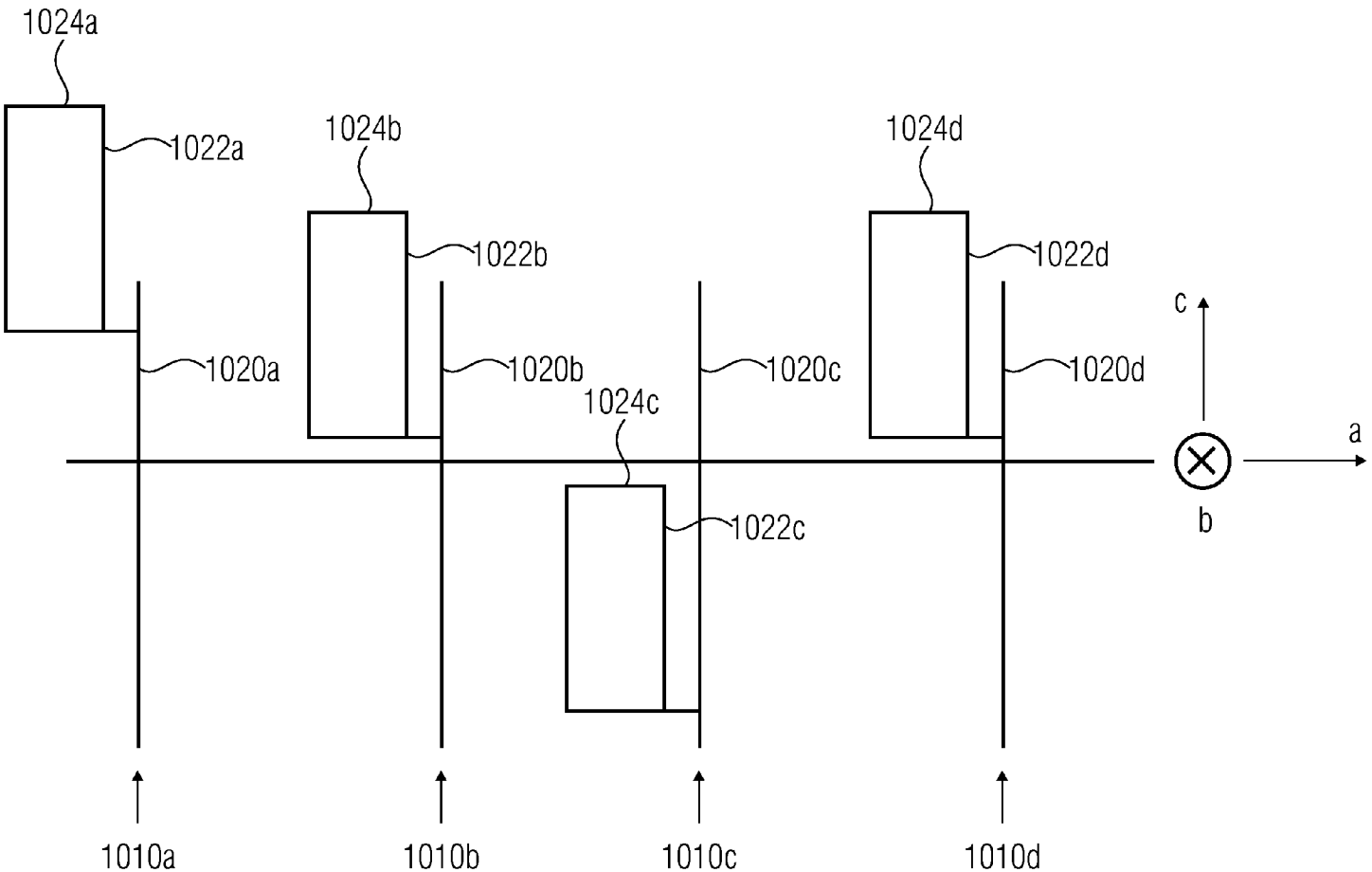
FIG. 10 is a side view on a transport mechanism according to FIG. 9*c* according to an embodiment.

One possibility for realizing the transport mechanism 950 will be described below with reference to FIG. 10. For this purpose, FIG. 10 shows a side view of an exemplary transport mechanism. The transport mechanism according to FIG. 10 is indicated by 1000 in its entirety. The transport mechanism 1000 comprises, for example, the plurality of individual transport mechanism 1010*a*, 1010*b*, 1010*c*, 1010*d*, which are driven, for example, via a common shaft 1020 or another common driving mechanism. The individual transport mechanisms 1010*a*, 1010*b*, 1010*c*, 1010*d* can, for example, be transport mechanisms 900 or 930, respectively, as have been described based on FIGS. 9*a* and 9*b*.

For clarity reasons, the individual transport mechanisms 1010*a*, 1010*b*, 1010*c*, 1010*d* are only symbolized by driving elements 1010*a*-1020*b* with only one vibratory plate element 1022*a*-1022*d* each. However, each of the driving elements 1020*a*-1020*d* can also comprise several vibratory plate elements, as has been described based on the transport mechanisms 900, 930.

Further, the individual transport mechanisms 1010*a*-1010*d* are driven by a common driving shaft 1020 such that they perform their movements time-offset to each other, which means with a different phase position. While, for example, the vibratory plate element 1022*a* is an upper (or top) position and thus in contact with the product, for example, the vibratory plate elements 1022*b*, 1022*d* can be in raising or decreasing middle positions, respectively, such that, for example, the second vibratory plate element 1022*b* will soon transition to a bottom position, while the fourth vibratory plate element 1022*d* will soon transition to an upper position. Further, for example, the third vibratory plate element 1022*c* can be in a lower (or bottom) position.

Figure 11A:
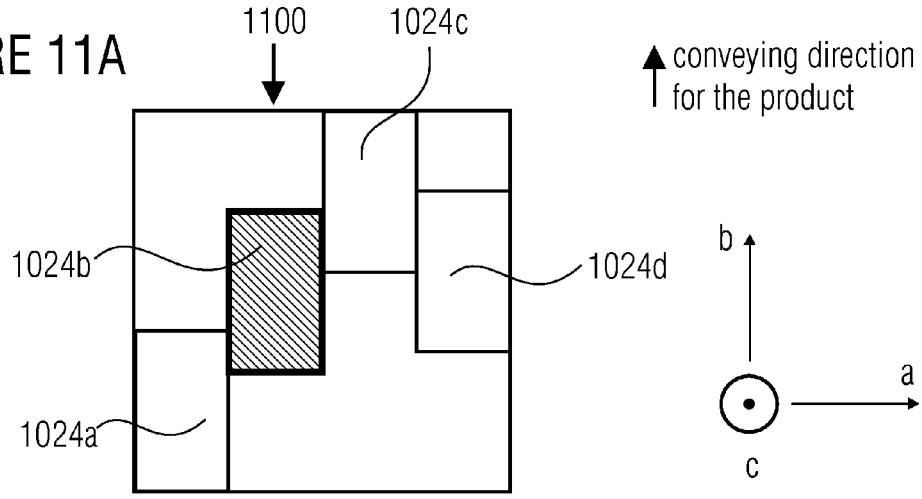
FIG. 11*a*-11*c* are top views of the movement of the vibratory plates in a transport mechanism according to FIG. 9*c*.
Figure 11B:
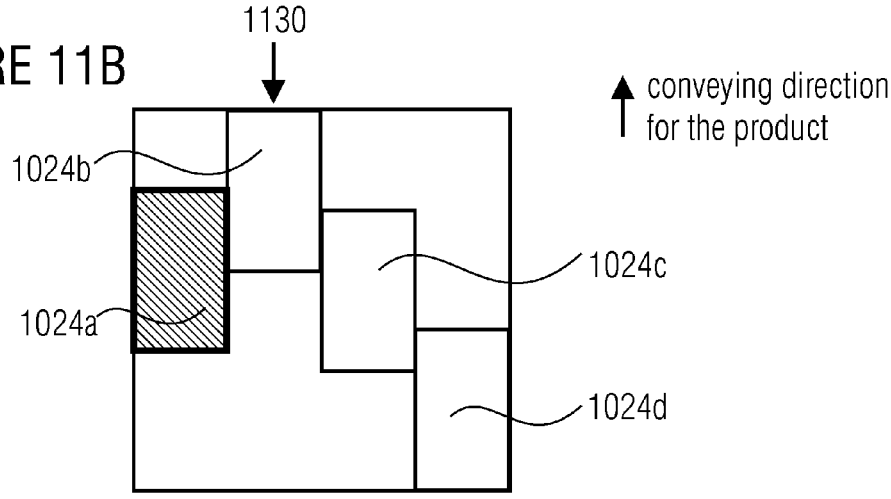
Figure 11C:
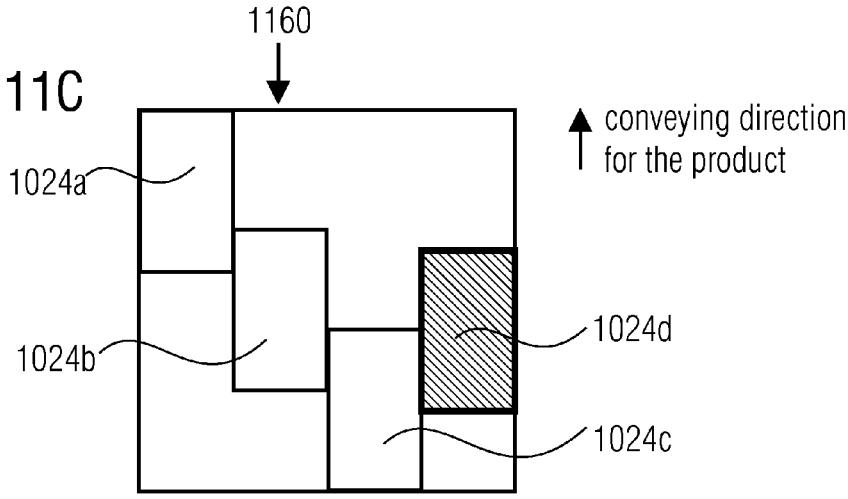

Here, it should be noted that in the graphical illustration of FIG. 10, different directions are indicated by a, b, and c, corresponding to a Cartesian coordinate system, for making reference to the orientation of FIGS. 11*a*-11*c*.

FIGS. 11*a*-11*c* show top views on the transport apparatus 1000 in different operating states.

A first top view 1100 shows an exemplary driving means according to FIG. 9*c* or 10, respectively, in the first operating stage, a second top view 1130 shows the respective transport mechanism in a second operating state, and a top view 1160 shows the transport mechanism in a third operating state. Top views 1100, 1130, 1160 show vibratory plate surfaces of the vibratory plate elements 960*a*, 960*d* or 1022*a*-1022*d*, respectively.

The top view 1130 shows, for example, the position of the transport mechanism 1000 shown in FIG. 10. A vibratory plate surface 1024*a* is in a top position (in contact with the products) and is thus illustrated in a shaded manner. A vibratory plate surface 1024*b* is in a middle position and moves downward, a vibratory plate surface 1024*c* is in a bottom position (which means remote from the products) and a vibratory plate surface 1024*d* is in a middle position and moves upward.

At a later time, i.e. for example, approximately one quarter of a period later, the vibratory plate surface 1024 is in a middle position and moves downward. The vibratory plate surface 1024 is in a bottom position, the vibratory plate surface 1024*c* is in a middle position and moves upward. The vibratory plate surface 1024*d* is in an upper position (shaded). The respective state can be seen in the top view 1160.

Correspondingly, the top view 1100 shows a state existing, for example, approximately one quarter of a period prior to the state according to the top view 1130.

If the states are passed according to FIGS. 11*a*, 11*b*, 11*c*, a product will be conveyed corresponding to the shown direction.

It should be noted explicitly that size and distance ratios as shown in FIGS. 9*a*, 9*c*, 10 and 11*a*-11*c* are merely exemplarily. Further, the actual directions of movement can differ from the directions of movement shown in FIG. 9*a*-9*c*, 10 and 11*a*-11*c*. For example, one or several of the vibratory plate surfaces can move at an angle, as, for example, has been shown based on FIGS. 7*a* to 7*c*.

Further, it should be noted that the transport mechanisms according to FIGS. 9*a*-9*c*, 10 and 11*a*-11*c* can be used in the arrangements according to FIGS. 1 to 8*c*. Thus, for example, a transport mechanism 900 or 930, respectively, can be used for replacing individual ones or all of the elements 168*a*, 168*b*, 168*c*. Further, the transport mechanism 950 can, for example, be used for replacing one of the elements 168*a*. Alternatively, the transport mechanism 950 can replace all of the elements 168*a*, 168*b*, 168*c*. Further, it should be noted that the transport mechanism 950 can be extended, for example, by adding further elements. Generally, however, it is sufficient when the transport mechanism 950 comprises at least two elements 960*a*, 960*b*.

Further, all in all, it has to be stated that in one embodiment the transport mechanisms according to FIG. 9*a*-9*c*, 10 and 11*a*-11*c* can replace the eccentric mechanism according to FIG. 3.

Further, it should be noted that also the different methods according to embodiments of the present invention corresponding to the functionalities described based on FIG. 9*a*-9*c*, 10 and 11*a*-11*c* can be adapted or supplemented.

Depending on the circumstances, the method of the invention can be implemented in hardware or in software. The implementation can be made on a digital memory medium, e.g. a disc or a CD, with electronically readable control signals that can cooperate with a programmable computer system such that the respective method is performed. Thus, generally, the invention also consists of a computer program product with a program code for performing the method according to embodiments of the invention stored on a machine-readable carrier, when the computer program product runs on a computer. In other words, the invention can thus be realized as a computer program with a program code for performing the method when the computer program runs on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for conveying products from a stack to an output, comprising:

a stack area configured for receiving a stack of a plurality of products, wherein the stack area comprises a base plate with a surface for receiving the products and a stop transversal to a stacking direction of the products;

a guiding element extending to the output; and a transport mechanism configured for acting on one or several of the products in the stack for conveying the products in the direction of the output, such that edges of the products abut on the guiding element, wherein the transport mechanism is implemented such that one transport element of the transport mechanism is disposed above the surface of the base plate during a movement from a first position to a second position, for raising at least part of the products in the stack, for moving them in the raised position in the direction of the guiding element and the stop, and for lowering them on the surface of the base plate, the direction having an angle with respect to a feed direction of the products and with respect to the direction of the output.

2. The apparatus according to claim 1, wherein the transport mechanism is configured for moving the transport element from the first position in the direction of the output to the second position in a first section of a transport cycle, and moving the transport element from the second position back to the first position in a second section of the transport cycle, wherein the transport element of the transport mechanism is oriented with the surface of the base plate in the first position and in the second position.

3. The apparatus according to claim 1, wherein the transport element of the transport mechanism is arranged below the surface of the base plate during the movement from the second position to the first position.

4. The apparatus according to claim 1, wherein the transport element comprises one element or a plurality of elements for engaging the products, wherein the base plate comprises a number of recesses corresponding to the number of elements.

5. The apparatus according to claim 4, wherein the plurality of elements are arranged on a common plate.

6. The apparatus according to claim 1 comprising a further transport mechanism, which is configured for acting on at least one further part of the products in the stack, for conveying the products in the direction of the output, such that edges of the products abut on the guiding element.

7. The apparatus according to claim 6, wherein the further transport mechanism is arranged in parallel to the first transport mechanism and is configured for being driven in a reverse manner in relation to the first transport mechanism.

8. The apparatus according to claim 1, wherein the transport mechanism comprises a drive arranged at an adjustable angle in relation to the transport element for moving the transport element in the direction of the output during the first section of the transport cycle.

9. The apparatus according to claim 8, wherein one drive is provided for each of the elements.

10. The apparatus according to claim 8, wherein the drive comprises an eccentric drive for raising and lowering the transport element in relation to the surface of the base plate and for moving the transport element between the first and second positions.

11. The apparatus according to claim 1, wherein the transport mechanism effects a pre-separation of the products.

12. The apparatus according to claim 1, wherein the stack area is configured for receiving the products upright on edges, such that the transport mechanism acts on the edges of the products, wherein the output is arranged in a direction transversal to the stacking direction of the products.

13. The apparatus according to claim 1, wherein the guiding element comprises a guiding sheet and/or a transport element.

14. The apparatus according to claim 1 comprising a feed transport for receiving the products, effectively coupled to the stack area, for moving the products from the feed transport to the stack area.

15. The apparatus according to claim 1, wherein the transport mechanism comprises a driving element with at least two vibratory plate elements, wherein the driving element is implemented for guiding the vibratory plate elements such that vibratory plate surfaces of the vibratory plate elements alternately act on one or several of the products in the stack during operation.

16. The apparatus according to claim 15, wherein the transport mechanism is implemented such that the different vibratory plates act, during operation, on one or several of the products in the stack in a time-offset manner with regard to their operating phases.

17. A paper handling apparatus comprising an apparatus according to one of claims 1 to 16, wherein the paper handling apparatus is selected from a group comprising a supplement feeder for withdrawing products from a stack and for separating the products through the gap or a folding unit.

18. A method for conveying products from a stack of a plurality of products to an output, wherein the stack is arranged in a stack area comprising a base plate with a surface for receiving the products, a stop transversal to a stacking direction of the products and a guiding element extending to the output, the method comprising:

acting on one or several of the products in the stack for conveying the products in a direction of the output such that edges of the products abut on the guiding element, wherein the acting on the one or the several products comprises:

moving a transport element above the base plate from a first position to a second position to thereby raise at least part of the products in the stack above the surface of the base plate, moving the part of the products in the raised position in the direction of the guiding element and the stop, the direction having an angle with respect to a feed direction of the products and with respect to the direction of the output, and lowering the part of the products on the surface of the base plate.

19. The method according to claim 18, wherein in a first section of the transport cycle at least part of the products in the stack are raised above the surface of the base plate, moved in the direction of the output and lowered on the surface of the base plate, and the products are not conveyed in a second section of the transport cycle.

20. The method according to claim 18, wherein the products are arranged in the stack on edges in an upright manner, wherein the output is arranged in a direction transversal to a stacking direction of the products.

21. A computer program product comprising a program code stored on a machine-readable carrier for performing the method for conveying products from a stack of a plurality of products to an output, wherein the stack is arranged in a stack area comprising a base plate with a surface for receiving the products, a stop transversal to a stacking direction of the products and a guiding element extending to the output, the method comprising:

acting on one or several of the products in the stack for conveying the products in a direction of the output such that edges of the products abut on the guiding element, wherein the acting on the one or the several products comprises:

moving a transport element above the base plate from a first position to a second position to thereby raise at least part of the products in the stack above the surface of the base plate, moving the part of the products in the raised position in the direction of the guiding element and the stop, the direction having an angle with respect to a feed direction of the products and with respect to the direction of the output, and lowering the part of the products on the surface of the base plate, when the program product runs on a computer.

* * * * *